US009121270B2

(12) United States Patent
Seitter

(10) Patent No.: US 9,121,270 B2
(45) Date of Patent: Sep. 1, 2015

(54) PUMP SYSTEM

(75) Inventor: Larry E. Seitter, Olathe, KS (US)

(73) Assignee: Grundfos Pumps Corporation, Olathe, KS (US)

( * ) Notice: Subject to any disclaimer, the term of this patent is extended or adjusted under 35 U.S.C. 154(b) by 1105 days.

(21) Appl. No.: 13/116,734

(22) Filed: May 26, 2011

(65) Prior Publication Data

US 2012/0301320 A1 Nov. 29, 2012

(51) Int. Cl.

| | |
|---|---|
| ***F04D 13/10*** | (2006.01) |
| ***E21B 43/12*** | (2006.01) |
| ***F04D 15/00*** | (2006.01) |

(52) U.S. Cl.

CPC ..... *E21B 43/128* (2013.01); *F04D 13/10* (2013.01); *F04D 15/0066* (2013.01)

(58) Field of Classification Search

CPC .... E21B 43/128; F04D 13/10; F04D 15/0066
USPC ..... 417/38, 44.2, 244, 414
See application file for complete search history.

(56) References Cited

U.S. PATENT DOCUMENTS

| | | | | |
|---|---|---|---|---|
| 3,394,733 | A * | 7/1968 | Jacuzzi | 137/565.34 |
| 4,741,208 | A | 5/1988 | Vandevier | |
| 4,798,247 | A | 1/1989 | Deaton et al. | |
| 5,015,151 | A | 5/1991 | Snyder, Jr. et al. | |
| 5,466,127 | A | 11/1995 | Arnswald | |
| 5,580,221 | A | 12/1996 | Triezenberg | |
| 5,700,958 | A * | 12/1997 | Lew et al. | 73/861.357 |
| 5,883,489 | A | 3/1999 | Konrad | |
| 5,941,690 | A | 8/1999 | Lin | |
| 6,349,765 | B1 | 2/2002 | Meyers et al. | |
| 6,587,037 | B1 | 7/2003 | Besser et al. | |
| 6,695,052 | B2 | 2/2004 | Branstetter et al. | |
| 6,729,849 | B2 | 5/2004 | Fong | |
| 6,873,267 | B1 | 3/2005 | Tubel et al. | |
| 6,981,399 | B1 | 1/2006 | Nybo et al. | |
| 7,093,651 | B2 | 8/2006 | Meyers et al. | |
| 7,658,227 | B2 | 2/2010 | Fox et al. | |
| 2003/0198557 | A1 | 10/2003 | Fong | |
| 2007/0175633 | A1 | 8/2007 | Kosmala et al. | |
| 2008/0236821 | A1 | 10/2008 | Fielder | |
| 2008/0262736 | A1 | 10/2008 | Thigpen et al. | |
| 2008/0294097 | A1 | 11/2008 | Kim et al. | |
| 2008/0306892 | A1 | 12/2008 | Crossley et al. | |
| 2009/0044938 | A1 | 2/2009 | Crossley et al. | |
| 2009/0162223 | A1 | 6/2009 | Lyngholm | |
| 2009/0222497 | A1 | 9/2009 | Ryan | |

* cited by examiner

*Primary Examiner* — Charles Freay
*Assistant Examiner* — Philip Stimpert
(74) *Attorney, Agent, or Firm* — Jay J. Hoette; The Small Patent Law Group, LLC

(57) ABSTRACT

A submersible pump system includes a submersible pump assembly having one or more stages of impellers and a submersible motor assembly that drives the pump assembly. The submersible pump assembly includes a motor housing, a motor within the motor housing for driving the pump assembly and a control module mounted to the motor housing for operating the motor. The control module is electrically connected to a power line and comprises a controller and a variable frequency drive driven by the controller. The controller operates the variable frequency drive to drive the motor to maintain a constant pressure output condition from the pump assembly.

16 Claims, 4 Drawing Sheets

PUMP SYSTEM

BACKGROUND OF THE INVENTION

The subject matter herein relates generally to pump systems, and more particularly, to control systems for submersible pump systems.

Submersible pump systems typically include a submersible pump assembly and a motor assembly for driving the pump assembly. The pump assembly and motor assembly are inserted in a bore-hole or storage tank. Piping extends between the pump assembly and point of use and the pump assembly pumps fluid to that point of use. Some pump systems are configured to provide constant pressure at the point of use. A control device controls the operation to maintain the constant pressure condition. The control device uses a control scheme or control algorithm to maintain the constant pressure condition. However, the control algorithm typically uses factory settings for controlling the motor assembly.

Furthermore, some pump systems are utilized to maintain constant pressure in piping systems that have a high resiliency characteristic or a low resiliency characteristic. The pump systems do not take into consideration the resiliency of the piping system.

A need remains for a pump system that is adaptable to maintain a constant pressure output condition. A need remains for a pump system that factors in the resiliency characteristic of the piping system for operating the pump system.

BRIEF DESCRIPTION OF THE INVENTION

In one embodiment, a pump system is provided having a submersible pump assembly that has one or more stages of impellers. The pump assembly discharges fluid to a piping system. A motor assembly drives the pump assembly and has a motor housing and a motor within the motor housing for driving the pump assembly. A control module is coupled to the motor assembly for operating the motor to maintain a constant pressure output condition in the piping system. The control module operates the pump based on a resiliency of the piping system.

In another embodiment, a pump system is provided having a submersible pump assembly that has one or more stages of impellers. The pump assembly discharges fluid to a piping system. A motor assembly drives the pump assembly and has a motor housing and a motor within the motor housing for driving the pump assembly. A control module is coupled to the motor assembly for operating the motor to maintain a constant pressure output condition in the piping system. The control module conducts a flow test to determine a flow slope of change in pressure over time in the piping system. The control module compares the flow slope to a calibrated flow slope that is calibrated based on a resiliency of the piping system.

In another embodiment, a method of operating a pump system pumping fluid into a piping system is provided. The method includes determining a resiliency level of a piping system. The method includes operating a pump assembly based on the resiliency level of the piping system. The method includes conducting a flow test based on the resiliency level of the piping system to determine if flow is occurring in the piping system.

In a further embodiment, a method of operating a pump system pumping fluid into a piping system is provided. The method includes testing the pump system to determine a calibrated pump speed reduction based on a resiliency of the piping system. The method includes testing the pump system to determine a calibrated flow slope of change in pressure over time of the fluid in the piping system based on a resiliency of the piping system. The method includes stabilizing the pressure in the piping system. The method includes conducting a flow test using the calibrated pump speed reduction and the calibrated flow slope to determine if flow is present.

DETAILED DESCRIPTION OF THE INVENTION

Figure 1:
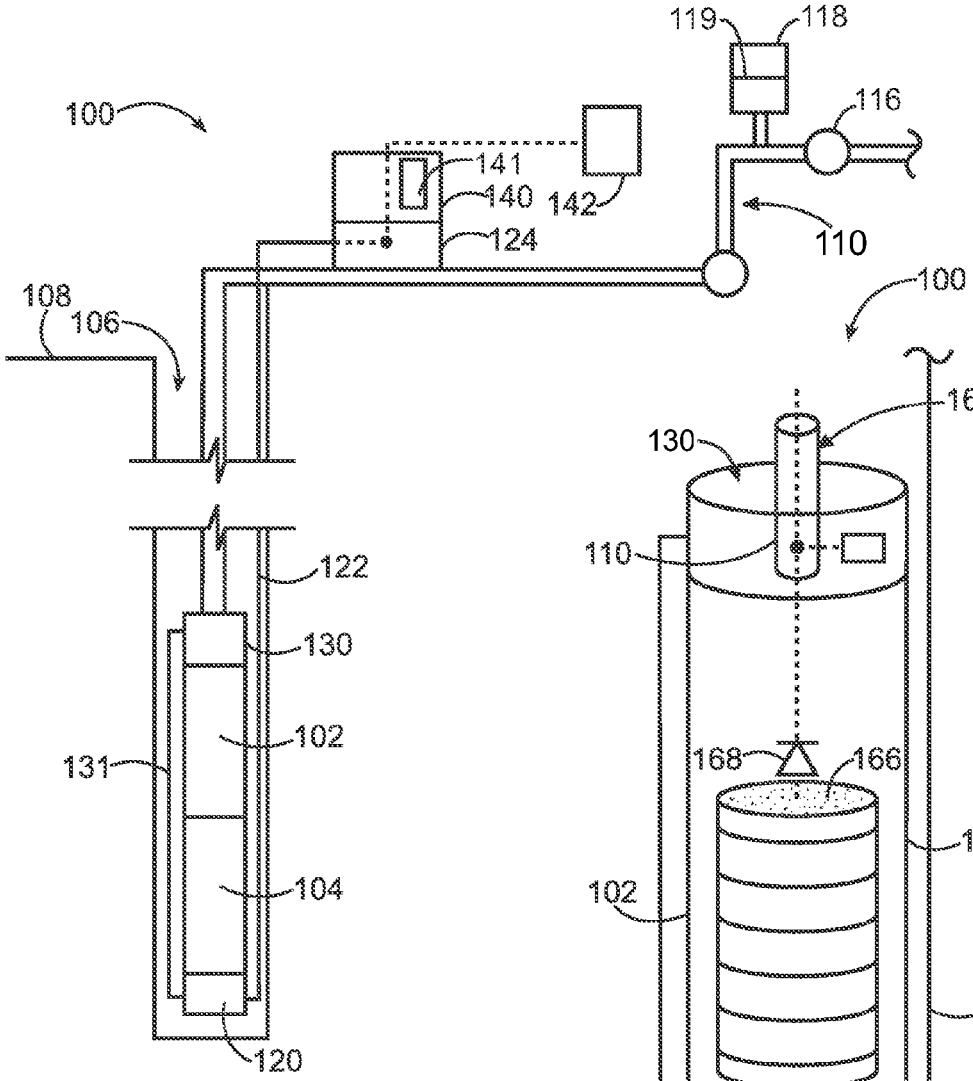
FIG. 1 illustrates a pump system formed in accordance with an exemplary embodiment.

FIG. 1 illustrates a pump system 100 formed in accordance with an exemplary embodiment. The pump system 100 includes a submersible pump assembly 102 and submersible motor assembly 104 arranged within a bore-hole 106. The pump system 100 includes a piping system 110 that delivers fluid to discharge points. The pump assembly 102 is coupled to the piping system 110 to deliver pressurized fluid to the piping system 110. The piping system 110 exhibits a resiliency characteristic by which the piping system 110 elastically deforms when fluid is introduced into the piping system 110 under pressure. The pump assembly 102 delivers fluid to the piping system 110 under pressure which expands the various components of the piping system 110. The resiliency characteristic is a function of the amount of expansion of the various components of the piping system 110 and/or the change in volume of the various components of the piping system 110. The resiliency characteristic is a measure of the ability of the various components of the piping system 110 to expand and then return to an unloaded state. The resiliency characteristic is a measure of the ability of the various components of the piping system 110 to absorb energy and/or of the ability of the various components of the piping system 110, upon unloading, to release the absorbed energy.

Figure 2:
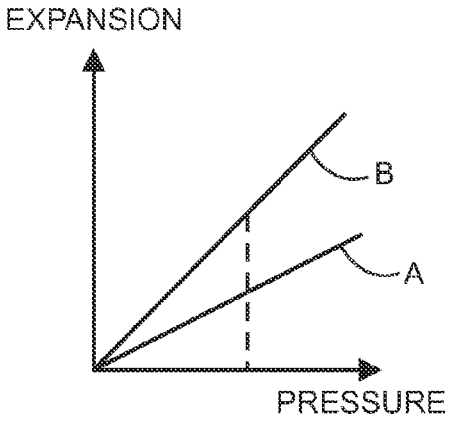
FIG. 2 is a graph showing resiliency characteristics of different piping systems.

FIG. 2 is a graph showing resiliency characteristics of different piping systems. The graph plots pressure along the X-axis and expansion or change in volume along the Y-axis. The graph shows a low resiliency curve A and a high resiliency curve B. The resiliency is the area under the curves A, B.

For the low resiliency curve A, an increase in pressure correlates with an increase in expansion. The low resiliency curve A is illustrated as being generally linear, however, the low resiliency curve A may be non-linear in alternative embodiments. For example, the slope of the curve may increase or decrease with an increase in pressure. The slope of the low resiliency curve A is based upon one or more factors relating to the piping system 110, such as the type of pipe used, the amount of pipe used, other components in the piping system, and the like.

For the high resiliency curve B, an increase in pressure correlates with an increase in expansion. The amount of expansion for a given pressure is greater for the high resiliency curve B than the low resiliency curve A. The high resiliency curve B is illustrated as being generally linear, however, the high resiliency curve B may be non-linear in alternative embodiments. The slope of the high resiliency curve B is based upon one or more factors relating to the piping system 110, such as the type of pipe used, the amount of pipe used, other components in the piping system, and the like.

Returning to FIG. 1, the pump system 100 is operated based on the resiliency characteristic of the piping system 110. For example, the pump system 100 may be operated differently when used with a piping system 110 having a high resiliency than when used with a piping system 110 having a low resiliency. The resiliency characteristic of the piping system 110 may be determined, and the pump assembly 102 and motor assembly 104 operated differently based on the resiliency characteristic. An efficiency of the pump assembly 102 and motor assembly 104 may be increased by controlling the operation thereof based on the resiliency characteristic of the piping system 110. For example, the motor assembly 104 may be operated at a constant pressure setting, and the constant pressure algorithm controlling the motor assembly 104 may be adjusted based on the resiliency characteristics, making the system more efficient.

The motor assembly 104 drives the pump assembly 102. In an exemplary embodiment, the pump assembly 102 is a constant pressure pump assembly 102. The motor assembly 104 is operated to drive the pump assembly 102 to maintain constant pressure. The motor assembly 104 is operated to turn on, turn off, speed up and/or slow down the pump assembly 102 to maintain a constant pressure condition.

The bore-hole 106 extends a depth from a surface 108 and the pump assembly 102 and motor assembly 104 are lowered into the bore-hole 106 to a depth from the surface 108. The pump assembly 102 may be used in water storage tanks rather than in bore holes. The piping system 110 includes pipes that extend from the pump assembly 102 to the surface 108, such as into a building or other structure or located out of doors. The pump assembly 102 pumps a fluid within the bore-hole 106 to the building at the surface 108.

The piping system 110 includes a plurality of pipes above the surface 108 within the building that deliver the fluid to one or more discharge points 116, such as faucets, within the structure. The pipes may be of a traditional rigid copper pipe type or the pipes may be manufactured from another material, such as a plastic material that is flexible and/or expansive. An example of plastic pipes is cross-linked polyethylene (PEX) pipes. The type of material used for the pipes may affect the resiliency of the overall piping system 110, and thus the overall pump system 100. For example, PEX pipes have the ability to expand and be partially, elastically deformed when pressurized, whereas copper pipes are much more rigid and expand much less if at all as compared to PEX pipes. Using PEX pipes increases the resiliency of the piping system 110 as compared to piping systems 110 that use copper pipes. Furthermore, the length of the pipes of the piping system 110 affects the resiliency in the piping system 110.

Piping systems 110 having more pipes or a longer total length of pipes tend to have a higher resiliency as compared to when more rigid or a shorter length of pipes are used. Having more flexible pipes or a longer length of pipes causes the pipes to expand further and absorb more pressure in the piping system 110 as compared to when more rigid or a shorter length of pipes are used. As the pump assembly 102 boosts the pressure in the piping system 110, the increase in pressure is at least partially absorbed by the pipes, depending on the resiliency of the pipes. Having more flexible pipes or a longer length of pipes allows a greater percentage of the boost in pressure to be absorbed, and the pressure in the pipes is less affected by the boost in pressure from the pump assembly 102. Having more rigid pipes or a shorter length of pipes allows a smaller percentage of the boost in pressure to be absorbed, and the pressure in the pipes is more affected by the boost in pressure from the pump assembly 102. The pressure is more quickly increased in the piping system 110 having the more rigid pipes and/or the shorter length of pipes than the system having the more flexible pipes and/or the longer length of pipes.

In an exemplary embodiment, the piping system 110 includes an expansion tank or a diaphragm tank 118. The diaphragm tank 118 absorbs pressure applied to the piping system 110. The diaphragm tank 118 is a vessel or container divided in two by a rubber diaphragm 119 that is movable within the vessel. The vessel includes a dry side under air pressure and a wet side that is connected to, and receives fluid from, the piping system 110. The pump system 100 may utilize diaphragm tanks 118 that vary in size from a relatively small tank having a fluid capacity of approximately 2 gallons, to a relatively large tank having a fluid capacity of approximately 20-30 gallons or more.

The size of the diaphragm tank 118 affects the resiliency of the overall pump system 100. Using a larger diaphragm tank 118 increases the resiliency of the pump system 100 as compared to pump systems 100 that use smaller diaphragm tanks 118. For example, a larger diaphragm tank 118 has the ability to expand further and store more pressure in the piping system 110 as compared to a smaller diaphragm tank 118. As the pump assembly 102 boosts the pressure in the piping system 110, the increase in pressure is at least partially absorbed by the diaphragm tank 118. Having a large diaphragm tank 118 allows a greater percentage of the boost in pressure to be absorbed. Having a smaller diaphragm tank 118 allows a smaller percentage of the boost in pressure to be absorbed. The pressure is more quickly increased in the piping system 110 having the smaller diaphragm tank than the system having the larger diaphragm tank 118.

The motor assembly 104 may include a control module 120 having electronics and/or software that control the operation of the motor assembly 104. The control module 120 may have a user interface. The control module 120 may be located at the surface 108 and have a network connection for communicating with other components of the pump system. The control module 120 may include a display. The control module 120 may include one or more processors, microprocessors, controllers, microcontrollers, or other logic based devices that operate based on instructions stored on a tangible and non-transitory computer readable storage medium. One or more inputs may be received by the control module 120, which define control parameters that affect the control scheme. For example, a control method, such as the control methods shown in FIGS. 4-7, may be embodied in one or more processors that operate based on hardwired instructions or software applications stored on one or more memories. The memories may be or include electrically erasable programmable read only memory (EEPROM), simple read only memory (ROM), programmable read only memory (PROM), erasable programmable read only memory (EPROM), FLASH memory, a hard drive, or other type of computer memory.

Power is supplied to the control module 120 via a power line 122 that extends from a power source 124 at the surface 108. The power line 122 extends down through the bore-hole 106 to the control module 120. The power supplied by the power line 122 is used to drive the motor assembly 104. The control module 120 controls the power supply to the motor assembly 104 based on a power scheme. In an exemplary embodiment, the motor assembly 104 and control module 120 are positioned within the bore-hole 106 below the pump assembly 102. In an alternative embodiment, the control module 120 may be provided at the surface 108 and connected to the power line 122 for controlling the supply of power to and operation of the motor assembly 104.

A sensor module 130 is coupled to a pipe of the piping system 110. The sensor module 130 senses at least one fluid parameter of the fluid pumped through the piping system 110 by the pump assembly 102. For example, the sensor module 130 may sense a pressure, a temperature, a flow volume and/or a flow rate of the fluid pumped through the piping system 110. Alternatively, the sensor module 130 may be coupled to the piping system 110 at the surface 108, rather than, or in addition to, within the bore-hole 106. Optionally, a sensor module 130 may be positioned within the bore-hole 106 proximate to the pump assembly 102.

The control module 120 operates the motor assembly 104 based on the signals transmitted from the sensor module 130. In an exemplary embodiment, the control module 120 operates the motor assembly 104 to maintain at least one constant fluid parameter output condition from the pump assembly 102, such as a constant pressure output condition. While the description herein relates to a pump assembly 102 operated at a constant pressure output condition, the pump assembly 102 may be operated to maintain another constant fluid parameter output condition, such as a constant flow rate, constant flow volume, and the like.

In an exemplary embodiment, the control module 120 operates the motor assembly 104 at a variable speed in order to maintain the constant pressure output condition from the pump assembly 102. The sensor module 130 monitors a pressure of the output from the pump assembly 102 and communicates a pressure reading to the control module 120, which operates the motor 182 (shown in FIG. 3) of the motor assembly 104 to maintain the constant pressure output condition at the sensor module 130.

In an exemplary embodiment, the pump system 100 includes a communication module 140 spatially separated from the control module 120. In the illustrated embodiment, the communication module 140 is located at the surface 108. The communication module 140 is communicatively coupled to the control module 120, such as via powerline modems, and sends control signals to the control module 120 to change an operative parameter of the control module 120. The communication module 140 may include a display. The communication module 140 may include a network connection for interfacing with other components of the pump system 100. The communication module 140 may include a user interface 141 for interfacing with the pump system 100. The user may monitor operating conditions of the pump system 100 using the user interface 141. The user may input changes into the user interface 141, which may be transmitted via the communication module 140 to the control module 120. A remote control 142 may be provided for communicating with the communication module 140.

Figure 3:
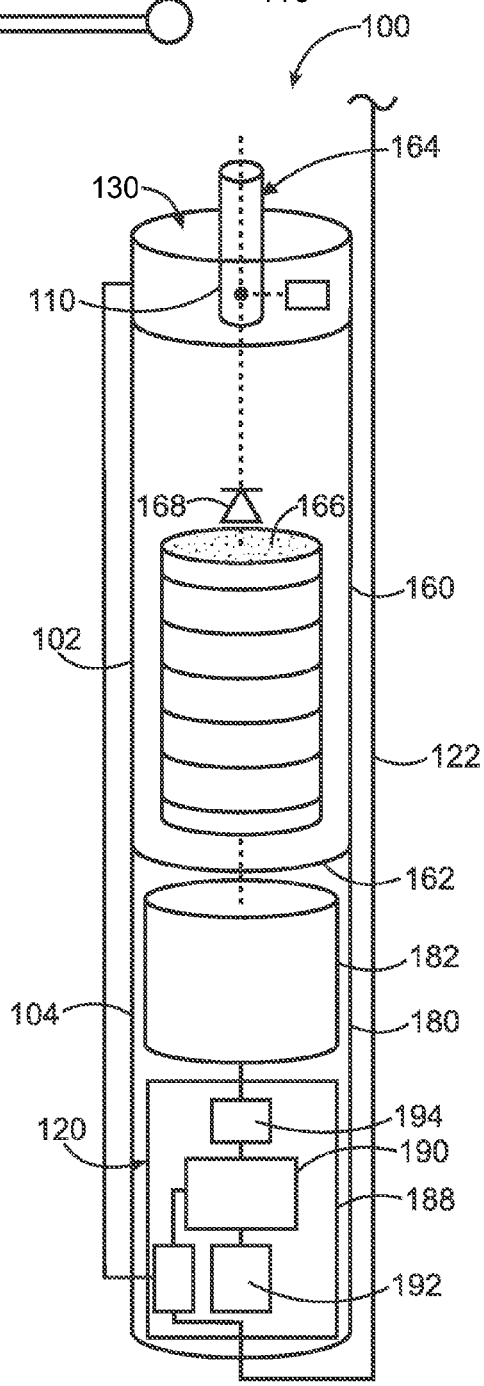
FIG. 3 is a schematic diagram of a portion of the pump system showing a pump assembly and motor assembly formed in accordance with an exemplary embodiment.

FIG. 3 is a schematic diagram of the pump assembly 102 and motor assembly 104 formed in accordance with an exemplary embodiment. The pump assembly 102 includes a pump housing 160 having an inlet end 162 and a discharge end 164. Fluid, such as water, is drawn into the pump assembly 102 through the inlet end 162. The fluid is pumped out of the discharge end 164 at an increased pressure.

In an exemplary embodiment, the pump assembly 102 is a multi-stage pump assembly having a plurality of impellers 166 arranged in multiple stages for increasing the pressure of the fluid pumped through the pump assembly 102. Any number of impeller stages may be provided. Optionally, the pump assembly 102 may include a single stage rather than multiple stages of impellers 166. In an exemplary embodiment, the pump assembly 102 includes a check valve 168 at the discharge end 164. The check valve 168 restricts back flow through the pump assembly 102.

The motor assembly 104 includes a motor housing 180. A motor 182 is held within the motor housing 180. The control module 120 is mounted to the motor housing 180. In an exemplary embodiment, the control module 120 is housed within the motor housing 180. Alternatively, the control module 120 may include a separate housing that is mounted to the motor housing 180 or is held within the bore-hole 106 completely separate from the motor housing 180.

The motor 182 is operatively coupled to the pump assembly 102 for driving the pump assembly 102. For example, the motor 182 may drive a pump shaft of the pump assembly 102, which drive the impellers 166. In the illustrated embodiment, the motor 182 is a permanent magnet motor. Other types of motors may be used in alternative embodiments, such as an induction motor.

The control module 120 includes electronic components configured to control and drive the motor 182. The electronic components may be mounted on a circuit board 188 housed within the motor housing 180. In an exemplary embodiment, the control module 120 includes a controller 190 that operates the motor 182 in accordance with a control scheme. The control module 120 includes a power converter 192.

The control module 120 includes a drive component 194 that controls the motor 182. The drive component 194 is coupled to the controller 190 and operated based on the control scheme established by the controller 190. In an exemplary embodiment, the drive component 194 is a variable frequency drive, and may be referred hereinafter as variable frequency drive component 194. The variable frequency drive component 194 controls the rotational speed of the motor 182 by controlling the frequency of the electrical power supplied to the motor 182. By controlling the speed of the motor 182, the pressure of the fluid output by the pump assembly 102 may be controlled. For example, the motor 182 may drive the pump assembly 102 to maintain a constant pressure output condition from the pump assembly 102. The speed of the motor 182 may be constantly adjusted (e.g. sped up or slowed down) in order to maintain the constant pressure output condition.

Figure 4:
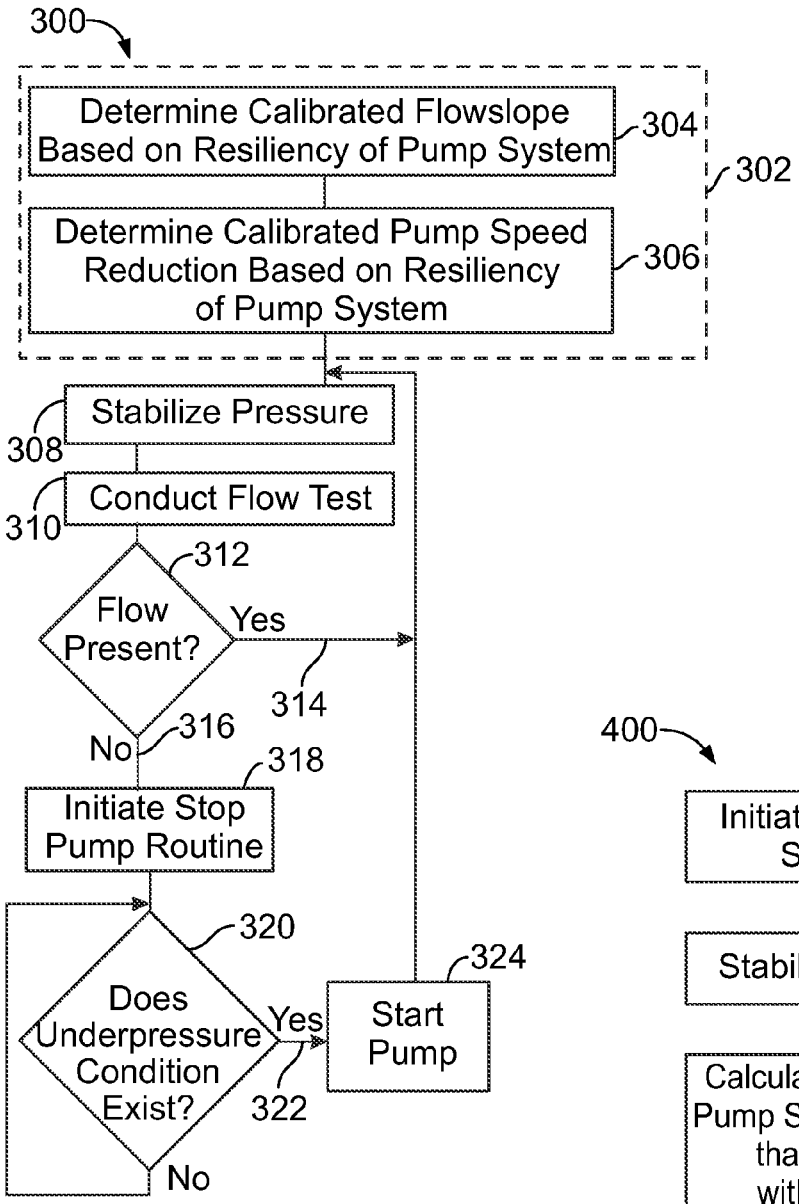
FIG. 4 is a flow chart showing an exemplary method of operation of the pump system.

FIG. 4 is a flow chart showing an exemplary method 300 of operating of a constant pressure pump system. The method 300 may be utilized with the pump system 100 (shown in FIG. 1) incorporating the various components of the pump system 100. While the method 300 is described with reference to the pump system 100, it is realized that the method may be utilized with a different pump system having one or more different components than the pump system 100 in alternative embodiments.

The method 300 is used to maintain a constant pressure output condition from the pump assembly 102. The method 300 includes a sub-method 302 of calibrating the pump system 100 by determining a resiliency level or resiliency characteristic, generally referred to as a resiliency, of the piping system 110 and/or the pump system 100. The resiliency is used to determine some control parameters for the control module 120. The control parameters are used by the control module 120 to control the motor assembly 104 and the pump assembly 102. Because the resiliency is variable based on the components of the piping system 110, the control parameters are likewise variable, allowing different control schemes which are based on the resiliency of the piping system 110.

The pump system 100 is operated by applying power to the motor assembly 104. The power is transmitted from the power source 124 through the power line 122 to the control module 120. The control module 120 controls the power supply to the motor 182 in accordance with a particular control scheme. The control scheme uses the control parameters, some of which are based on the resiliency level of the pump system 100. The resiliency level may be affected by factors such as the size (e.g. capacity) of the diaphragm tank 118, the type of material of the pipes of the piping system 110, the total pipe length of the pipes, and the like. Having a higher resiliency level causes the pump system 100 to react slower. Controlling the pump system 100 based on the resiliency level may lead to better performance and/or a more efficient pump system 100.

In an exemplary embodiment, at 302, when the pump system 100 is first used, or during a set-up phase, the control module 120 performs a test to determine the resiliency of the piping system 110 and/or the pump system 100. The pump system may use such testing to determine some control parameters that are used by the control module 120 to control the motor assembly 104 and the pump assembly 102. The test sequence may be automatic or may be performed upon demand.

Figure 5:
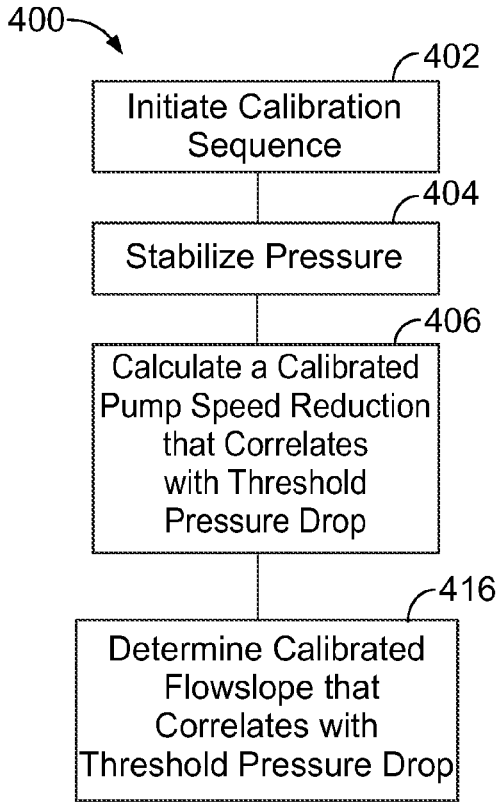
FIG. 5 is a flow chart showing an exemplary method of conducting a resiliency determination procedure in accordance with an exemplary embodiment.
Figure 6:
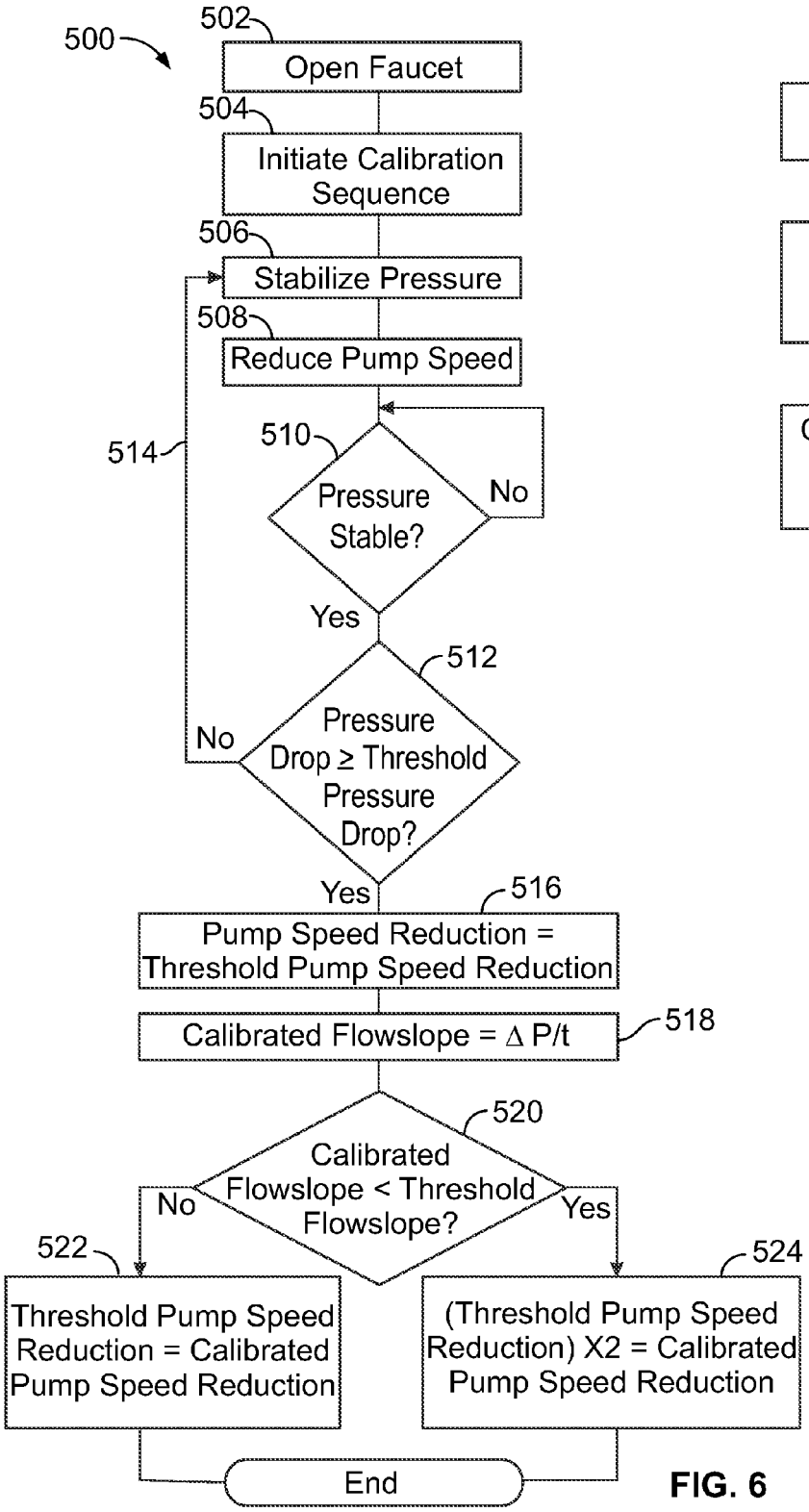
FIG. 6 is a flow chart showing an exemplary method of conducting a resiliency determination procedure in accordance with an exemplary embodiment.
Figure 7:
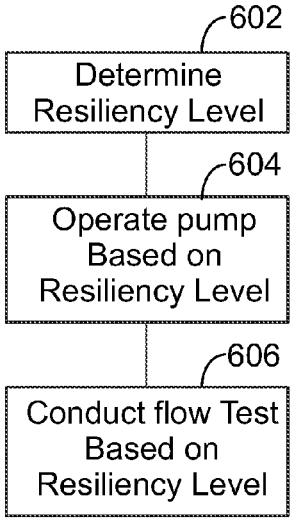
FIG. 7 is a flow chart showing an exemplary method of operation of the pump system.
Figure 8:
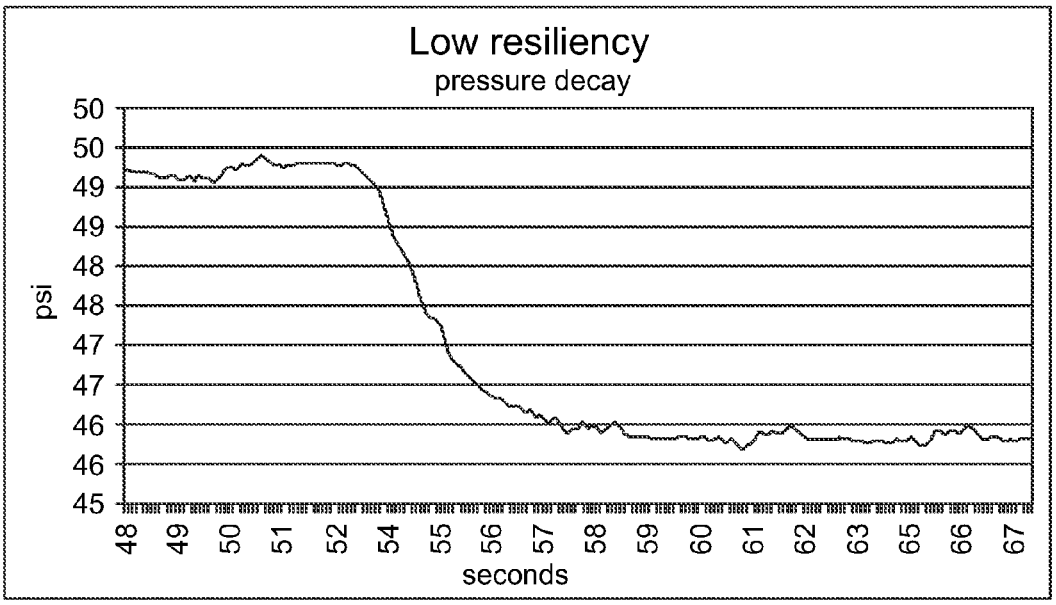
FIG. 8 illustrates an exemplary flow slope for a pump system having a low resiliency.
Figure 9:
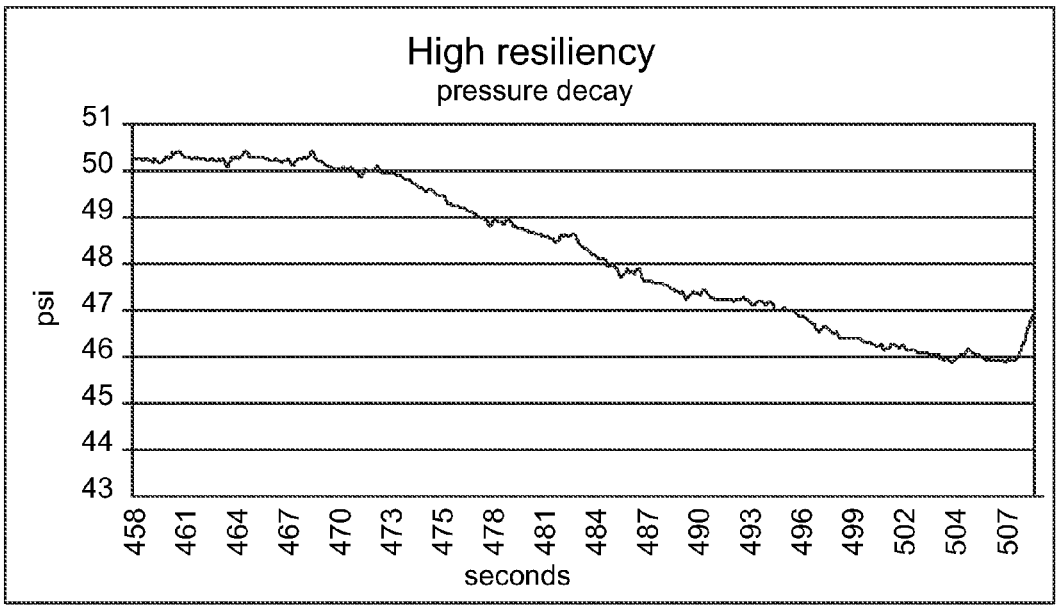
FIG. 9 illustrates an exemplary flow slope for a pump system having a high resiliency.

At 304, the control module 120 determines a calibrated flow slope based on the resiliency of the piping system 110. The calibrated flow slope is one control parameter that is used by the control module 120 to control the motor assembly 104 and the pump assembly 102 during normal operation of the pump system 100. The flow slope is the change in pressure over time (e.g. AP/t) of the fluid in the piping system 110. Examples of methods used to determine a calibrated flow slope are illustrated in FIGS. 5-7. Examples of different flow slopes are illustrated in FIGS. 8 and 9, showing an exemplary flow slope for a pump system 100 having a low resiliency in FIG. 8 and an exemplary flow slope for a pump system 100 having a high resiliency in FIG. 9. At a given pump speed, the flow slope may be different for piping system 110 having a high resiliency level as compared to piping system 110 having a low resiliency level. For example, the flow slope may be less for piping system 110 having a high resiliency level.

At 306, the control module 120 determines a calibrated pump speed reduction amount based on the resiliency of the piping system 110. The calibrated pump speed reduction amount is one control parameter that is used by the control module 120 to control the motor assembly 104 and the pump assembly 102 during normal operation of the pump system 100. Examples of methods used to determine a calibrated pump speed reduction amount are illustrated in FIGS. 5-7. The calibrated pump speed reduction amount may be used during flow tests performed by the pump system 100 to determine if flow is occurring in the piping system 110. The calibrated pump speed reduction amount may be expressed in terms of RPMs. Alternatively, the calibrated pump speed reduction amount may be expressed in different terms, such as in terms of a percentage of the operating pump speed. The calibrated pump speed reduction amount may relate to an amount of speed reduction required to cause a predetermined amount of pressure drop in the system while flow is present (e.g. approximately 2-3 psi). Such pressure drop is indicative of use of, or flow in, the pump system 100.

Once the control parameters of calibrated flow slope, calibrated pump speed reduction, or other control parameters relating to resiliency are determined, the pump system 100 may be operated normally. During operation, the pump system 100 applies power to the motor assembly 104 from the power source 124 via the power line 122. The pump system 100 is operated according to a normal control scheme. The control module 120 operates the motor 182 to maintain a constant pressure output condition from the pump assembly 102 at a setpoint pressure ($P_{setpoint}$).

At 308, the pump system 100 stabilizes the pressure in the piping system 110. When stabilized, the pump system maintains a constant pressure output condition, which may be a particular pressure value, or alternatively, may be a range of pressure values. For example, in order to maintain a constant pressure output condition, the pump system 100 may be operated to maintain the pressure of the fluid pumped from the pump assembly 102 within a pressure range of +/−X psi from the setpoint pressure ($P_{setpoint}$). In an exemplary embodiment, the user may desire a pressure of 50 psi within the piping system 110 in the building. Other setpoint pressures may be desired in alternative embodiments. The control module 120 operates the motor assembly 104 by speeding up or slowing down the motor assembly 104 to maintain the constant pressure output condition. The control module 120 may utilize a PID loop to maintain the constant pressure output condition. The control module 120 uses the control parameters that relate to the resiliency of the piping system 110 to control the operation. For example, the resiliency based control parameters are variables that may be used by the control module 120 to adjust the PID loop.

In an exemplary embodiment, the control scheme of the control module 120 may be based on the presence or absence of flow within the piping system 110 of the building. For example, the pump system 100 may operate differently when flow is present.

At 310, the pump system 100 conducts a flow test. At 312, the pump system 100 determines if flow is present. In an exemplary embodiment, the pump system 100 uses the sensor module 130 to determine if flow is present. During the flow test, the motor 182 and pump assembly 102 speed may be reduced by the calibrated pump speed reduction amount, and then the pressure measured. The calibrated pump speed reduction amount is determined during the calibration method 302. The calibrated pump speed reduction amount is based on the resiliency of the piping system 110.

The control module 120 uses the calibrated flow slope to determine if flow is occurring within the piping system 110. For example, the control module 120 may determine a flow slope of the pump system 100 during the flow test and compare the measured flow slope with the calibrated flow slope. The calibrated flow slope is determined during the calibration method 302. The calibrated flow slope is based on the resiliency level of the piping system 110. If the measured flow slope is greater than or equal to the calibrated flow slope, then flow is occurring. When a valve at a fixture is opened, the pressure within the piping system 110 drops at a rate equal to or greater than the drop in pressure during the calibration sequence, indicating that flow is occurring.

At 314, when flow is occurring, the pump system 100 loops to maintain normal operation. The pump speed is ramped back up so that the pressure is maintained at the setpoint pressure ($P_{setpoint}$). The pump system 100 is again stabilized, at 308, until the next flow test is conducted, at 310. Optionally, flow tests may be conducted at regular intervals, such as every 10 seconds. As long as flow is occurring, the pump system 100 continues to loop to maintain the constant pressure output condition.

At 316, when the pump system 100 determines that no flow is present, the control module 120 will stop the motor 182 in accordance with a control scheme. At 318, the control module 120 initiates a stop pump routine in which the control module 120 operates the motor 182 to boost the pressure within the piping system 110 above the setpoint pressure. For example, the control module 120 may operate the motor 182 to drive the pump assembly 102 to increase the pressure within the piping system 110 to a boost value ($P_{boost}$), which may be equal to the setpoint pressure ($P_{setpoint}$) plus a predetermined amount. For example, the boost pressure ($P_{boost}$) may be equal to the setpoint pressure ($P_{setpoint}$) plus 7 psi. Other boost ($P_{boost}$) values are possible in alternative embodiments. Once the boost pressure ($P_{boost}$) value is reached, the control module 120 stops the motor 182.

At 320, while the pump is in the off condition, the control module 120 determines if an under-pressure condition occurs. An under-pressure condition may exist when the pressure measured is a predetermined amount below the setpoint pressure ($P_{setpoint}$). For example, when the pressure is less than ($P_{setpoint}$)−4 psi, an under-pressure condition exists. The control module 120 continues to monitor the pressure within the piping system 110, such as at regular intervals. If the under-pressure condition does not occur, the method will continue to loop, again determining if the under-pressure condition occurs, at 320. The control module 120 will continuously or periodically sample the pressure within the piping system 110 until the under-pressure condition is detected.

At 322, when an under-pressure condition exists, the control module 120 will start the motor 182, at 324, to increase the pressure to the setpoint pressure ($P_{setpoint}$) by operating the pump assembly 102 in a constant pressure mode. Once the control module 120 starts the motor 182, normal operation continues. The control module 120 stabilizes the pressure, at 308, and then conducts a flow test, at 310, to determine 312 if flow is present.

The methods 300, 302 are merely illustrative of an exemplary control and calibration operation of the pump system 100. The pump system 100 may be operated differently in alternative embodiments to maintain a constant pressure condition. The pump system 100 may use other control parameters in addition to the calibration parameters relating to the resiliency of the piping system 110. The pump system 100 may be operated according to other control schemes other than a constant pressure control scheme in alternative embodiments. While the control module 120 may be operated based on a pressure reading from the sensor module 130 proximate to the output of the pump assembly 102, the control module 120 may be operated based on other fluid parameters (e.g. temperature, flow volume, flow rate, etc.) and/or based on readings taken from other locations within the pump system 100 in addition to, or in the alternative to, the sensor module 130 in alternative embodiments.

FIG. 5 is a flow chart showing an exemplary method 400 of calibrating the pump system 100 by determining a resiliency level of the pump system 100. The resiliency is used to determine control parameters for the control module 120. The control parameters are used by the control module 120 to control the motor assembly 104 and the pump assembly 102. Because the resiliency is variable based on the components of the piping system 110, the control parameters are likewise variable, allowing different control schemes which are based on the resiliency of the piping system 110.

The pump system 100 is operated by initiating 402 a calibration sequence. Optionally, the calibration sequence may be initiated 402 when the pump system 100 is first set up. The calibration sequence may be initiated 402 using the remote control 142. The pump system 100 applies power to the motor assembly 104 to maintain a constant pressure output condition from the pump assembly 102 at a set point pressure. The pump system 100 is operated to stabilize 404 the pressure in the piping system 110.

The pump system 100 is operated to calculate 406 a pump speed reduction amount that correlates with a threshold pressure drop. The pump speed reduction amount may define a control parameter used by the control module 120 during the normal mode of operation. For example, the pump speed reduction amount may be used during a flow test to determine if flow is occurring. The pump speed reduction amount is based on the resiliency level of the pump system 100. The pump speed reduction amount may be expressed in terms of RPMs. Alternatively, the pump speed reduction amount may be expressed in different terms, such as in terms of a percentage of the operating pump speed. The pump speed reduction amount relates to an amount of speed reduction required to cause a predetermined amount of pressure drop in the system while flow is present (e.g., approximately 2-3 psi). Such pressure drop is indicative of use or flow in the pump system 100. The predetermined amount of pressure drop is the threshold pressure drop used by the method 400 to calculate 406 the pump speed reduction amount. In one exemplary embodiment, the method 500 of calibrating the pump system 100 shown in FIG. 6 may be used to calculate 406 a pump speed reduction amount. Other methods may be used in alternative embodiments to calculate 406 a pump speed reduction amount.

The pump system 100 determines 416 the calibrated flow slope that correlates with the threshold pressure drop. The flow slope is the change in pressure over time (e.g., $\Delta P/t$) of the fluid in the piping system 110. The flow slope is affected by the resiliency of the piping system 110. As such, the calibrated flow slope is a function of the resiliency of the pump system 100.

The method 400 of calibrating the pump system 100 is used to determine control parameters that are based on the resiliency of the pump system 100. For example, the method 400 may determine a calibrated pump speed reduction amount and a calibrated flow slope, both of which may be used by the control module 120 to control the operation of the pump assembly 102.

FIG. 6 is a flow chart showing an exemplary method 500 of calibrating the pump system 100. The method 500 is used to determine a resiliency level of the piping system 110. The resiliency is used to determine some control parameters for the control module 120. The control parameters are used by the control module 120 to control the motor assembly 104 and the pump assembly 102. Because the resiliency is variable based on the components of the piping system 110, the control parameters are likewise variable, allowing different control schemes which are based on the resiliency of the piping system 110.

At 502, the method 500 includes opening a faucet. Having the faucet open ensures flow is occurring during the calibration sequence. At 504, with the faucet open, the calibration sequence is initiated. At 506, the pump system 100 is operated to stabilize the pressure in the piping system 110. The pressure is stabilized to maintain a constant pressure output condition. The pump assembly 102 is operated to maintain the constant pressure output condition. The pressure is considered stabilized when the flow slope is less than a predetermined amount, such as less than 0.1 psi/second. The flow slope is the change in pressure over time (e.g., ΔP/t) of the fluid in the piping system 110.

At 508, with the pressure stabilized, the pump speed is reduced by a predetermined amount, such as 100 RPMs. At 510, the pump system 100 is continued to be operated at the reduced pump speed until the pressure is stabilized at the reduced pump speed. At 512, the control module 120 determines if the amount of pressure drop at the reduced pump speed is greater than or equal to a threshold pressure drop. At 514, when the amount of pressure drop is less than the threshold pressure drop, then the method 500 follows the return loop path and the pump system 100 is ramped back up to the set point pressure and is stabilized, at 506, at the set point pressure. The pump speed is again reduced, at 508, however the amount of pump speed reduction is increased in the second iteration. For example, in the second iteration, the pump speed reduction may be 200 RPMs rather than 100 RPMs. The pressure is stabilized, at 510, at the reduced pump speed and the control module 120 again determines, at 512, if the amount of pressure drop at the reduced pump speed is greater than or equal to the threshold pressure drop. The method 500 will continue to loop additional iterations as needed further reducing the pump speed until the amount of pressure drop is greater than or equal to the threshold pressure drop. Once the amount of pressure drop is greater than or equal to the threshold pressure drop, the control module 120 equates the amount of pump speed reduction that delivers such pressure drop to be a threshold pump speed reduction. The control module 120 may save the threshold pump speed reduction in memory.

At 518, when the amount of pressure drop is greater than or equal to the threshold pressure drop, the control module 120 calculates a calibrated flow slope. The calibrated flow slope is the change in pressure over time (e.g., ΔP/t) based on the amount of pump speed reduction that delivers a pressure drop greater than or equal to the threshold pressure drop. Because the flow slope is dependent on the resiliency level of the piping system 110, the calibrated flow slope is based on the resiliency level. The calibrated flow slope is an operating parameter that may be used by the control module 120 to operate the pump system 100. The calibrated flow slope is an operating parameter that may be used during a flow test.

At 520, the control module 120 determines if the calibrated flow slope is less than a threshold flow slope. The threshold flow slope may be established based on a predetermined resiliency of the piping system 110. At 522, if the calibrated flow slope is less than the threshold flow slope, then the resiliency of the piping system 110 is relatively low and the control module 120 equates the threshold pump speed reduction with a calibrated pump speed reduction. Alternatively, if the calibrated flow slope is greater than the threshold flow slope, then the resiliency of the piping system 110 is relatively high. At 524, the control module 120 sets a calibrated pump speed reduction to be equal to the threshold pump speed reduction multiplied by a predetermined multiplier, such as two times the threshold pump speed reduction. The calibrated pump speed reduction is used by the control module 120, such as during a flow test to determine if flow is occurring in the piping system 110. During the flow test, the pump speed is reduced, the system is stabilized, and the measured flow slope is compared with the calibrated flow slope to determine if flow is occurring. Having the pump speed reduced more allows a larger pressure drop to occur during the flow test. The larger pressure drop may be required in a piping system 110 having a higher resiliency in order to determine if flow is occurring. As such, by determining if the calibrated flow slope is less than a threshold flow slope, the control module 120 may have a calibrated pump speed reduction that is based on a resiliency level of the piping system 110.

FIG. 7 is a flow chart showing a method 600 of operating the pump system 100 based on a resiliency level of the pump system 100. The resiliency level is used to determine control parameters for the control module 120. The control parameters are used by the control module 120 to control the motor assembly 104 and the pump assembly 102. Because the resiliency is variable based on the components of the piping system 110, the control parameters are likewise variable, allowing different control schemes which are based on the resiliency of the piping system 110.

At 602, the control module 120 determines a resiliency level of the piping system 110. The resiliency level may be a number or grading of the piping system 110 that takes into account different factors that affect the resiliency of the pump system 100. For example, the resiliency level may be a number on a 1-10 scale or on a 1-100 scale or another scale. The size of the diaphragm tank 118, the material used for the pipes of the piping system 110, the total pipe length of the pipes, and the like may all affect the resiliency of the pump system 100. The resiliency level corresponds with the ability of the piping system 110 to absorb pressure and/or impart pressure into the system. The diaphragm tank 118 and/or pipes of the piping system 110 will expand and contract with varying applied pressure, resulting in a certain resiliency. At 604, the pump assembly 102 is operated based on the resiliency level. At 606, the control module 120 conducts flow tests based on the resiliency level to determine if flow is occurring in the piping system 110. For example, the flow tests may be conducted at periodic intervals to maintain a constant pressure output condition for the pump system 100. Parameters of the flow tests may be based on the resiliency of the piping system 110.

At 602, the resiliency level may be determined using a calibration method, such as the calibration method 400 or the calibration method 500 (shown in FIGS. 5 and 6). Rather than using a grade for the resiliency level to operate the pump assembly 102 and/or conduct the flow test, the pump system 100 may determine the resiliency level by calculating or measuring one or more control parameters that are based on the resiliency level. Such control parameters may be used by the control module 120 to operate the pump assembly 102 and/or conduct the flow test. For example, a calibrated flow slope may be determined, which is based on the resiliency level of the pump system 100. The calibrated flow slope is the change in pressure over time (e.g., ΔP/t) of the fluid in the piping system 110. A calibrated pump speed reduction may be determined, which is based on the resiliency level of the pump system 100. The calibrated pump speed reduction may correlate with a pressure drop that is greater than or equal to a threshold pressure drop that is approximately equal to a pressure drop due to an open faucet. Other parameters that relate the resiliency level of the piping system 110 may be calculated and used by the control module 120 to operate the pump assembly 102 and/or to conduct a flow test.

At 604, the pump assembly 102 is operated based on the resiliency level. For example, when the resiliency level of the piping system 110 is determined, the operation of the motor assembly 104 may be altered or tailored based on the resiliency level. For example, when the motor assembly 104 is operated in a constant pressure setting or mode, the algorithm or software controlling the operation of the motor assembly 104 may be adjusted based on the resiliency level. For example, the motor assembly 104 may be controlled by a PID loop or other type of feedback loop to maintain a constant pressure output for the pump system 100. Certain parameters of the PID loop may be based on the resiliency of the piping system 110, causing the motor assembly 104 to operate differently for high resiliency piping systems as compared to low resiliency piping systems. For example, the motor assembly 104 may react more quickly to perform adjustments in speed. In one embodiment, the motor assembly 104 may ramp up speed more quickly, such as when used with a high resiliency piping system. For example, because a high resiliency piping system expands more, it may be desirable to operate the motor assembly 104 at a higher speed at start up. In one embodiment, the motor assembly 104 may slow down the speed of the pump assembly 102 more quickly for high resiliency piping systems. In other embodiments, the motor assembly 104 may operate for longer periods of time or for shorter periods of time based on the resiliency of the piping system 110. In other embodiments, the motor assembly 104 may sample flow or conduct flow tests more frequently or less frequently depending on the resiliency level of the piping system. For example, for low resiliency piping systems, the motor assembly 104 may conduct flow tests more often or at shorter intervals. Other control parameters may be affected by resiliency as well.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A method of operating a pump system pumping fluid into a piping system, the piping system exhibits a resiliency characteristic by which the piping system elastically deforms when the fluid is introduced under pressure, the method comprising:

determining a resiliency level of the piping system based on the resiliency characteristic of the piping system as being one of at least a low resiliency level and a high resiliency level;

operating a pump assembly based on the resiliency level of the piping system, wherein the pump assembly is operated differently when the piping system is the low resiliency level as compared to when the piping system is the high resiliency level; and conducting a flow test based on the resiliency level of the piping system to determine if flow is occurring in the piping system.

2. The method of claim 1, wherein the piping system includes a diaphragm tank and a plurality of pipes, said determining the resiliency level comprises determining the resiliency level of the piping system based on a size of the diaphragm tank, a type of material of the pipes, and a total pipe length of the piping system.

3. The method of claim 1, wherein said determining the resiliency level comprises determining an amount of pressure absorbed by the piping system.

4. The method of claim 1, wherein the piping system includes a diaphragm tank and a plurality of pipes, said determining the resiliency level comprises determining an amount of expansion of the diaphragm tank and the pipes of the piping system.

5. The method of claim 1, wherein the pump assembly includes a control module, said operating the pump assembly comprises operating the control module in a first control scheme when the resiliency level of the piping system is characteristic of the low resiliency level of the piping system and operating the control module in a second control scheme when the resiliency level of the piping system is characteristic of the high resiliency level of the piping system.

6. The method of claim 1, wherein said operating the pump assembly comprises speeding up the pump assembly more quickly when the resiliency level of the piping system is the high resiliency level and speeding up the pump assembly more slowly when the resiliency level of the piping system is the low resiliency level.

7. The method of claim 1, wherein said operating the pump assembly comprises slowing down the pump assembly more quickly when the resiliency, level of the piping system is the high resiliency level and slowing down the pump assembly more slowly when the resiliency level of the piping system is the low resiliency level.

8. The method of claim 1, wherein said conducting the flow test comprises:

reducing a pump speed of the pump assembly by a pump speed reduction amount that correlates with the resiliency level;

stabilizing the pump system by achieving a constant pressure condition;

determining a flow slope of the pump assembly of the change in pressure over time of the fluid in the piping system; and comparing the flow slope with a calibrated flow slope based on the resiliency level of the piping system to determine if flow is occurring in the piping system.

9. The method of claim 1, further comprising:

testing the pump system to determine a calibrated pump speed reduction based on the resiliency characteristic of the piping system with flow present;

testing the pump system to determine a calibrated flow slope of change in pressure over time of the fluid in the piping system based on the resiliency characteristic of the piping system with flow present;

said determining the resiliency level is based on the calibrated flow slope and the calibrated pump speed reduction;

said conducting the flow test comprises conducting the flow test using the calibrated pump speed reduction and the calibrated flow slope to determine if flow is occurring.

10. A method of operating a pump system pumping fluid into a piping system, the piping system exhibits a resiliency characteristic by which the piping system elastically deforms when the fluid is introduced under pressure, the method comprising:

testing the pump system to determine a calibrated pump speed reduction based on the resiliency characteristic of the piping system with flow present;

testing the pump system to determine a calibrated flow slope of change in pressure over time of the fluid in the piping system based on the resiliency characteristic of the piping system with flow present;

stabilizing the pressure in the piping system; and conducting a flow test using the calibrated pump speed reduction and the calibrated flow slope to determine if flow is present.

11. The method of claim 10, wherein said conducting the flow test comprises:

reducing a pump speed of the pump assembly by the calibrated pump speed reduction amount;

stabilizing the pump system by achieving a constant pressure condition;

determining a flow slope of the pump assembly of change in pressure over time of the fluid in the piping system; and comparing the flow slope with the calibrated flow slope based on the resiliency characteristic of the piping system to determine if flow is occurring in the piping system.

12. The method of claim 10, wherein said conducting the flow test comprises conducting a series of flow tests at predetermined time intervals.

13. The method of claim 10, wherein said calibrating the pump system to determine the calibrated pump speed reduction comprises:

stabilizing the pump system by achieving a constant pressure condition;

reducing the pump speed by a predetermined amount;

stabilizing the pump system at the reduced pump speed;

measuring a drop in pressure at the reduced pump speed; and determining if the measured pressure drop is greater than or equal to a threshold pressure drop, if the measured pressure drop is greater than or equal to the threshold pressure drop then the predetermined amount of pump speed reduction is equal set to the calibrated pump speed reduction.

14. The method of claim 13, wherein said calibrating the pump system to determine the calibrated flow slope comprises:

measuring a flow slope of change in pressure over time of the fluid in the piping system at the reduced pump speed; and comparing the measured flow slope with a threshold flow slope;

if the measured flow slope is less than the threshold flow slope, then the predetermined amount of pump speed reduction is set to the calibrated pump speed reduction; and if the measured flow slope is greater than the threshold flow slope, then the calibrated pump speed reduction is set to the predetermined amount of pump speed reduction multiplied by a predetermined multiplier.

15. The method of claim 1, wherein said operating the pump assembly comprises controlling a speed of a motor of the pump assembly differently when the piping system is the low resiliency level as compared to when the piping system is the high resiliency level.

16. The method of claim 1, wherein said determining the resiliency level comprises using the pump assembly to automatically determine the resiliency level.

* * * * *